US006957033B2

(12) United States Patent
Saito et al.

(10) Patent No.: US 6,957,033 B2
(45) Date of Patent: Oct. 18, 2005

(54) IMAGE FORMATION APPARATUS HAVING INTERMEDIATE TRANSFER MEMBER AND ELECTRICALLY GROUNDED CONTACT MEMBER DISPOSED IN CONTACT WITH INTERMEDIATE TRANSFER MEMBER BETWEEN PRIMARY TRANSFER PORTION AND SECONDARY TRANSFER PORTION

(75) Inventors: Makoto Saito, Ibaraki (JP); Takeshi Tomizawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 10/665,428

(22) Filed: Sep. 22, 2003

(65) Prior Publication Data

US 2004/0062576 A1 Apr. 1, 2004

(30) Foreign Application Priority Data

Sep. 27, 2002 (JP) ..... 2002-284412

(51) Int. Cl.[7] ..... G03G 15/01
(52) U.S. Cl. ..... 399/302
(58) Field of Search ..... 399/298, 302, 399/299, 308, 313, 312

(56) References Cited

U.S. PATENT DOCUMENTS 6,088,567 A * 7/2000 Miyashiro et al. ..... 399/302
6,192,205 B1 * 2/2001 Motohashi ..... 399/302
6,226,469 B1 * 5/2001 Suzuki et al. ..... 399/302
6,298,212 B1 10/2001 Kono et al. ..... 399/302
6,477,340 B2 11/2002 Tomizawa et al. ..... 399/66

FOREIGN PATENT DOCUMENTS

JP 10-142953 * 5/1998
JP 2000-298408 10/2000

* cited by examiner

*Primary Examiner*—Susan Lee
(74) *Attorney, Agent, or Firm*—Fitzpatrick, Cella, Harper & Scinto

(57) ABSTRACT

An image formation apparatus has an image formation unit that forms toner images on an image holding member. A primary transfer unit transfers toner images on the image holding member onto an intermediate transfer member. A secondary transfer unit transfers toner images on the intermediate transfer member onto a recording medium. An electrically-grounded contact member first comes into contact with the intermediate transfer member downstream from a primary transfer portion. The relationship $$-2.0 \leqq ln(Vtr)-L/(s \times \log\rho) \leqq -1.0$$

is satisfied, in which L (mm) represents the distance from the primary transfer portion to a position where the intermediate transfer member first comes into contact with the contact member, Vtr (V) represents the absolute value of applied voltage to the primary transfer unit, s (mm/sec) represents the moving speed of the intermediate transfer member, and ρ(Ω/□) represents the surface resistivity of the intermediate transfer member.

8 Claims, 10 Drawing Sheets

AT LOW PEELING SPEED

AT HIGH PEELING SPEED

PRIOR ART

FIG. 9

| | SURFACE RESISTIVITY OF BELT log (ρ) [Ω/□] | PRIMARY TRANSFER BIAS Vtr[kV] | INTER-AXIAL DISTANCE L[mm] | PROCESSING SPEED s[mm/sec] | ATTENUANCE lnVtr−L/(s*logρ) | WIDENING OF LINE DRAWING UPSTREAM OF DRIVING ROLLER |
|---|---|---|---|---|---|---|
| COMPARATIVE EXAMPLE 1 | 10.8 | 0.1 | 34.7 | 130 | −2.327 | VISIBLE |
| EXAMPLE 1 | 11.2 | 0.2 | 34.7 | 130 | −1.633 | NONE |
| EXAMPLE 2 | 14.2 | 0.2 | 34.7 | 195 | −1.622 | NONE |
| EXAMPLE 3 | 12.6 | 0.3 | 34.7 | 130 | −1.225 | NONE |
| EXAMPLE 4 | 12.6 | 0.3 | 52.1 | 130 | −1.236 | NONE |
| EXAMPLE 5 | 12.8 | 0.35 | 34.7 | 65 | −1.092 | NEGLIGIBLE |
| COMPARATIVE EXAMPLE 2 | 12.6 | 0.5 | 34.7 | 65 | −0.736 | VISIBLE |
| COMPARATIVE EXAMPLE 3 | 12.2 | 0.5 | 34.7 | 130 | −0.715 | VISIBLE |
| COMPARATIVE EXAMPLE 4 | 12.2 | 0.5 | 17.3 | 130 | −0.704 | VISIBLE |
| COMPARATIVE EXAMPLE 5 | 9.5 | 0.5 | 17.3 | 130 | −0.707 | VISIBLE |
| COMPARATIVE EXAMPLE 6 | 11.8 | 0.8 | 52.1 | 130 | −0.257 | VISIBLE |
| COMPARATIVE EXAMPLE 7 | 12.6 | 0.5 | 34.7 | 130 | −0.714 | VISIBLE |
| COMPARATIVE EXAMPLE 8 | 12.8 | 0.5 | 34.7 | 195 | −0.707 | VISIBLE |
| COMPARATIVE EXAMPLE 9 | 12.8 | 0.9 | 34.7 | 65 | −0.147 | VISIBLE |

FIG. 10

| | SURFACE RESISTIVITY OF BELT log (ρ) [Ω/□] | DIAMETER OF DRIVING ROLLER R[mm] | WINDING ANGLE θ[deg] | logρ × R × θ/360 | WIDENING OF LINE DRAWING |
|---|---|---|---|---|---|
| EXAMPLE 6 | 12.2 | 31.7 | 169 | 181.55 | NONE |
| EXAMPLE 7 | 11.2 | 31.7 | 169 | 166.67 | NONE |
| EXAMPLE 8 | 12.8 | 31.7 | 169 | 190.48 | NONE |
| COMPARATIVE EXAMPLE 10 | 11.2 | 12 | 175 | 65.33 | NEGLIGIBLE |
| COMPARATIVE EXAMPLE 11 | 12.8 | 12 | 175 | 74.67 | NEGLIGIBLE |
| EXAMPLE 9 | 13.4 | 31.7 | 169 | 199.41 | NEGLIGIBLE |
| COMPARATIVE EXAMPLE 12 | 12.2 | 45 | 145 | 221.13 | VISIBLE |
| COMPARATIVE EXAMPLE 13 | 11.2 | 28 | 172 | 149.83 | NEGLIGIBLE |
| COMPARATIVE EXAMPLE 14 | 10.5 | 31.7 | 169 | 156.25 | NEGLIGIBLE |
| COMPARATIVE EXAMPLE 15 | 11.5 | 14 | 32 | 14.31 | VISIBLE |
| COMPARATIVE EXAMPLE 16 | 11.5 | 14 | 48 | 21.47 | NEGLIGIBLE |
| EXAMPLE 10 | 12.8 | 28 | 169 | 168.25 | NONE |

IMAGE FORMATION APPARATUS HAVING INTERMEDIATE TRANSFER MEMBER AND ELECTRICALLY GROUNDED CONTACT MEMBER DISPOSED IN CONTACT WITH INTERMEDIATE TRANSFER MEMBER BETWEEN PRIMARY TRANSFER PORTION AND SECONDARY TRANSFER PORTION

BACKGROUND OF THE INVENTION

1. Field of the Invention

The present invention relates to an image formation apparatus such as a printer, a photocopier, a facsimile machine, and the like, and specifically to an image formation apparatus employing a method wherein plural toner images each formed on an image holding member first are transferred by respective primary transfer operations onto an intermediate transfer member, superposed one on another, and then are transferred by a single secondary transfer operation onto a recording medium.

2. Description of the Related Art

FIG. 5 illustrates a conventional image formation apparatus and technique wherein toner images are transferred using an intermediate transfer member.

The surface of a photosensitive drum 1 is evenly charged by a charging roller 2, and then subjected to laser irradiation according to image information by an exposure device 3, thereby forming an electrostatic latent image thereon. The electrostatic latent image is developed (image manifestation) as a toner image t by toner having a charge (charged toner) being electrostatically adhered thereto by a developing device 4.

The toner image t on the photosensitive drum 1 is transferred in a primary transfer operation onto an intermediate transfer belt 5 (intermediate transfer member) at a primary transfer position (primary transfer nip) T1 by a primary transfer roller 6. This intermediate transfer belt 5 is reeved over a driving roller 21, a tension roller 22, and a secondary transfer inner roller 23. The toner image t on the intermediate transfer belt 5 is electrostatically transferred in a secondary transfer operation onto a recording medium P at a secondary transfer position (secondary transfer nip) T2 by a secondary transfer outer roller 24. The recording medium is transported into the secondary transfer position (nip) at a predetermined timing coinciding with the toner image t.

The recording medium P upon which the toner image t is transferred then is transported toward a fixing device 9 in the direction indicated by the arrow K1, and heated and pressed by the fixing device 9, whereby the toner image t is fixed onto the surface of the recording medium P.

Residual toner on the photosensitive drum 1 following the primary transfer operation is removed by a cleaning device 7, and residual toner on the intermediate transfer belt 5 following the secondary transfer operation is removed by an intermediate transfer member cleaner 10.

In an image formation apparatus using the above-described intermediate transfer method, the back side (interior facing side) of the intermediate transfer belt 5 is charged with reverse polarity relative to the charge polarity of the toner, in order to hold the charged toner on the surface of the intermediate transfer belt 5. That is to say, as shown in FIG. 6, in order to hold the charged toner at a negative polarity, for example, a positive charge applied to the back side of the intermediate transfer belt 5 electrostatically affects/holds the charged toner to the front surface of the intermediate transfer belt 5.

If the amount of charge on the back side of the intermediate transfer belt 5 varies (increases or decreases), the toner on the front side surface of the intermediate transfer belt 5 is electrostatically disturbed, which can result in unsuitable (degraded) images.

In such a case, as shown in FIG. 7, when line drawings or the like are formed on the intermediate transfer belt 5 as the belt 5 is passed through the primary transfer portion T1, marked scattering of toner occurs in front and back of the original line in the direction of travel(es) as the belt 5 approaches and passes the driving roller 21, which is the first contact member after (downstream of) the primary transfer position. As shown in FIG. 7, scattering of toner upstream and downstream of the line drawing becomes worse both before and after passing over the driving roller 21. Such scattering causes a widening of the line drawing in the direction of travel of the belt 5.

As shown in FIG. 8, a tension roller 22 over which the intermediate transfer belt 5 is reeved allows the charge on the back side of the intermediate transfer belt 5 to be diffused, thereby causing scattering of the toner particles held on the surface of the intermediate transfer belt 5.

Specifically, the charged back side of the intermediate transfer belt 5 comes into contact with the tension roller 22, which is electrically grounded, whereby charge escapes to ground. If a substantial amount of the charge on the back side of the intermediate transfer belt 5 escapes to ground, the amount of charge on the back side of the intermediate transfer belt 5 is less than the total amount of charge of the toner particles electrostatically drawn to the intermediate transfer belt 5, such that the force drawing the toner particles thereto is reduced, and toner particles scatter due to electrostatic repellence between the toner particles, resulting in this phenomenon.

On the other hand, Japanese Patent Laid-Open No. 2000-298408 and U.S. Pat. No. 6,298,212 disclose structures and methods in which a contact member which the intermediate transfer belt first comes into contact with after passing through the primary transfer position (such as a tension roller disposed immediately downstream of the primary transfer position in the moving direction of the intermediate transfer belt) controls the charge on the back side of the intermediate transfer belt 5 so that toner particles held thereon do not scatter.

Specifically, the following methods and arrangements are disclosed.

(1) The first contact member is grounded through a resistor with a high value.

(2) A high resistive layer (insulating layer) is provided on the surface layer of the first contact member.

(3) The first contact member is not grounded, thereby preventing exchange (drain) of charges.

(4) Applying a bias having the same polarity as the primary transfer to the first contact member, thereby holding the charge on the back side of the intermediate transfer belt 5.

However, the above-described means also have the following shortcomings.

(1) In the event of the first contact member being grounded through a resistor with a high value, providing the resistor with a high value leads to increased costs, and may also complicate the configuration in comparison with arrangements grounded without the resistor having a high value.

(2) In the event of providing a high resistive layer (insulating layer) on the surface of the first contact member, the insulating layer may peel off or become worn after long-time use, such that scattering of toner cannot be prevented in a reliable and stable manner for long-time use.

(3) In the event of the first contact member being not grounded, when continuously forming a great number of images, such as dozens to several hundred of images, the first contact member becomes charged up to several kV, which could damage the electric system of the image formation apparatus due to discharge of accumulated charge.

(4) In the event of applying a bias having the same polarity as the primary transfer to the first contact member, the configuration and control of the image formation apparatus may become complicated.

SUMMARY OF THE INVENTION

Accordingly, it is an object of the present invention to provide an image formation apparatus capable of continuously forming images having high quality, while effectively preventing toner held on an intermediate transfer member from scattering, with a simple configuration.

In order to achieve the above objects, an image formation apparatus comprises: image formation means for forming toner images on an image holding member; primary transfer means for transferring toner images formed on the image holding member onto an intermediate transfer member at a primary transfer portion; secondary transfer means for transferring toner images on the intermediate transfer member onto a recording medium at a secondary transfer portion; and a contact member which is electrically grounded and first contacts the intermediate transfer member downstream of the primary transfer portion in the moving direction of the intermediate transfer member, wherein the following relation is satisfied:

$$-2.0 \leqq ln(Vtr) - L/(s \times \log\rho) \leqq -1.0$$

where: L (mm) represents the distance from the primary transfer portion to a position where the contact member first contacts the intermediate transfer member, Vtr (V) represents the absolute value of a voltage applied to the primary transfer means, s (mm/sec) represents the moving speed of the intermediate transfer member, and ρ (Ω/□) represents the surface resistivity of the intermediate transfer member.

Further objects, features and advantages of the present invention will become apparent from the following description of the preferred embodiments with reference to the attached drawings.

BRIEF DESCRIPTION OF THE DRAWINGS

FIG. 9 is a table illustrating characteristics of widening of a line drawing in the event of changing surface resistivity of the belt, primary transfer bias, inter-axial distance, processing speed, and attenuance.

FIG. 10 is a table illustrating characteristics of widening of a line drawing in the event of changing surface resistivity of the belt, diameter of the driving roller, and winding angle.

DESCRIPTION OF THE PREFERRED EMBODIMENTS

Figure 1:
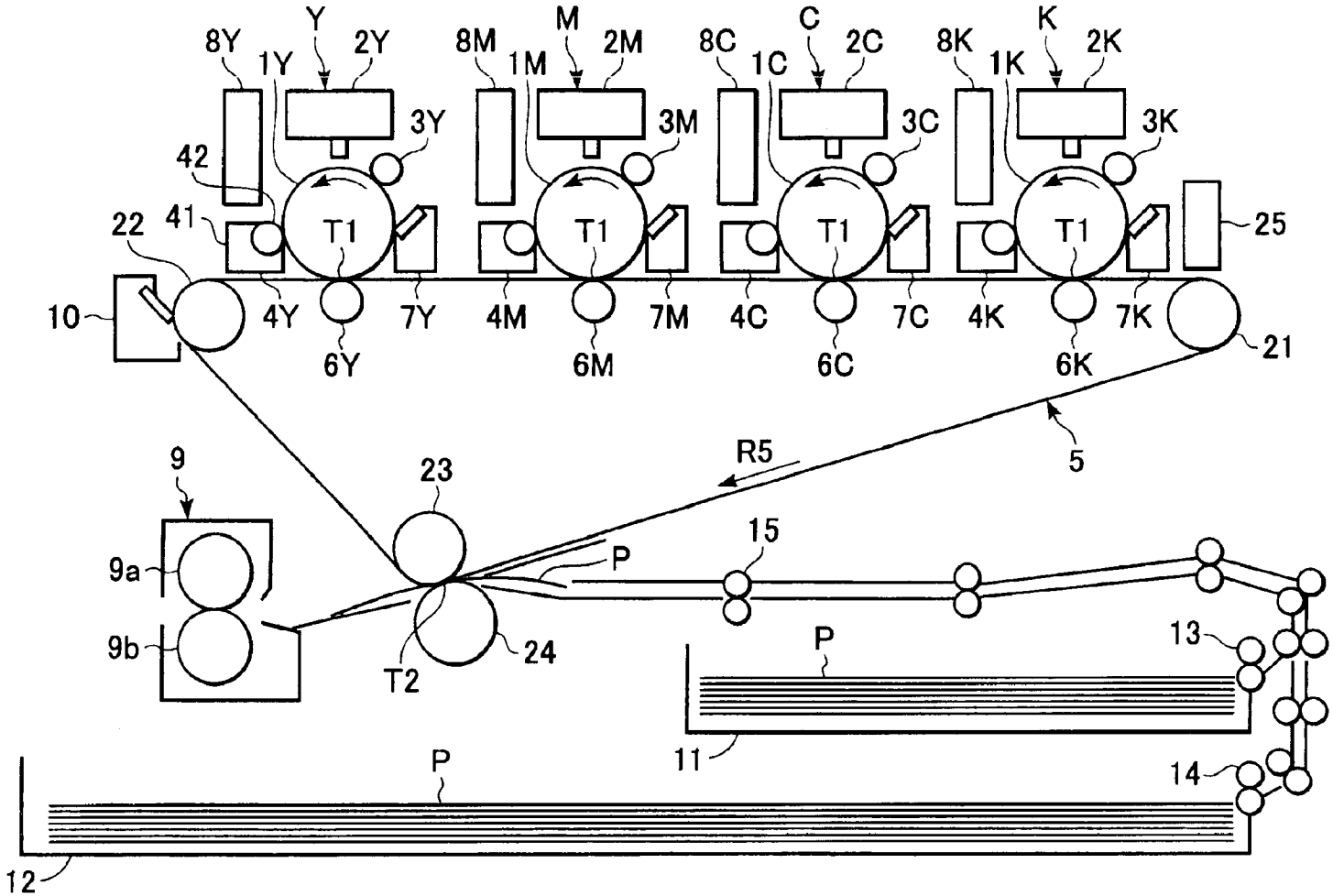
FIG. 1 is a vertical cross-sectional diagram illustrating a schematic configuration of an image formation apparatus according to the present invention.

An embodiment according to the present invention will now be described with reference to the drawings.

In the disclosed embodiments, the dimensions, materials, shapes, relative disposition, etc., of the components described herein, are not intended to restrict the scope of the present invention, unless specifically indicated. Also, the dimensions, materials, etc., of members described are to be understood to be the same throughout the various descriptions, unless specifically indicated to be otherwise. Moreover, components with the same reference numerals throughout drawings have the same configuration or perform the same operation, and thus redundant descriptions regarding these components have been omitted.

<First Embodiment>

FIG. 1 illustrates an image formation apparatus according to a first embodiment as an example of the image formation apparatus according to the present invention. The image formation apparatus shown in the drawing is a four-color full color image formation apparatus employing the electrophotography method, and the drawing is a vertical cross-sectional drawing illustrating the schematic configuration thereof. The configuration and operations of the overall image formation will be described with reference to this drawing.

The image formation apparatus shown in the drawing comprises four (four-color) image formation stations, i.e., image formation stations Y, M, C and K, for forming corresponding toner images of yellow, magenta, cyan and black, respectively. Each color toner image formed at these image formation stations Y, M, C and K is transferred in a primary transfer operation onto an intermediate transfer belt 5 so as to be overlaid (superposed), after which the superposed toner images are transferred in a single secondary transfer operation onto a recording medium P, such as a paper sheet; fixing of the secondary-transferred four-color toner image(s) yields four-color full color images.

The image formation stations Y, M, C and K comprise drum-type photosensitive members 1Y, 1M, 1C and 1K respectively, as image holding members (referred to as "photosensitive drums", hereafter). Each of the photosensitive drums 1Y, 1M, 1C and 1K is configured with a cylindrical outer circumferential face made of aluminum and having an outer diameter of 30 mm coated with OPC (Organic Photo Conductor) as a photosensitive layer. The surface of each photosensitive drum 1Y, 1M, 1C and 1K is evenly charged by a respective charging roller (charging means) 3Y, 3M, 3C and 3K, and subjected to laser irradiation from a respective exposure device 2Y, 2M, 2C and 2K, thereby forming an electrostatic latent image of each color.

Electrostatic latent images formed on the photosensitive drums 1Y, 1M, 1C and 1K are developed as toner images, where developing devices 4Y, 4M, 4C and 4K respectively store yellow, magenta, cyan and black toner and adhere/apply corresponding colored toner particles on the electrostatic latent images formed on the photosensitive drums.

Intermediate transfer belt 5 is an intermediate transfer member disposed below the four image formation stations Y, M, C and K. The intermediate transfer belt 5 is reeved around on a driving roller (first contact member) 21, a tension roller 22, and a secondary transfer inner roller 23, and is rotated and driven in the direction shown by the arrow R5, by driving the driving roller 21 in the clockwise direction. Primary transfer rollers 6Y, 6M, 6C and 6K are disposed on the interior side of the intermediate transfer belt 5 at positions corresponding to the photosensitive drums 1Y, 1M, 1C and 1K. Each of the primary transfer rollers 6Y, 6M, 6C and 6K presses the intermediate transfer belt 5 toward the surface of a respective photosensitive drum 1Y, 1M, 1C and 1K, thereby forming respective primary transfer positions (primary transfer nips) T1 between the photosensitive drums 1Y, 1M, 1C and 1K, and the intermediate transfer belt 5. A secondary transfer outer roller 24 is disposed on the exterior side of the intermediate transfer belt 5 at a position corresponding to the secondary transfer inner roller 23. The intermediate transfer belt 5 forms a secondary transfer position (secondary transfer nip) T2 between the intermediate transfer belt 5 and the secondary transfer outer roller 24, where the secondary transfer inner roller 23 presses the intermediate transfer belt 5 against the secondary transfer outer roller 24.

A transfer bias having a polarity reverse to each color toner is applied toward the primary transfer rollers 6Y, 6M, 6C and 6K, so as to successively perform primary transfer operations for each of the color toner images formed on the above-described photosensitive drums 1Y, 1M, 1C and 1K onto the intermediate transfer belt 5 at the corresponding primary transfer position T1. Thus, four one-color toner images are overlaid (superposed one on another) on the intermediate transfer belt 5. After the toner images are transferred, residual toner on the surface of the photosensitive drums 1Y, 1M, 1C and 1K (residual toner after primary transfer) is removed by cleaning devices 7Y, 7M, 7C and 7K, so that the photosensitive drums can be employed in a successive toner image formation operation.

Four-color toner images overlaid on the above-described intermediate transfer belt 5 are transported to the secondary transfer position T2 by rotation of the intermediate transfer belt 5 in the direction of arrow R5. A recording medium P (e.g., paper or transparent film) stored in a paper feeding cassette 11 or paper feeding cassette 12, is fed by a paper feeding roller 13 or paper feeding roller 14, and transported to a resist roller 15, e.g., by a guide path including transporting rollers (not numbered). The recording medium P is supplied to the secondary transfer position T2 by the resist roller 15 so as to synchronize timing with the four-color toner image on the intermediate transfer belt 5. As the recording medium P passes through the secondary transfer position T2, transfer bias is applied between the secondary transfer inner roller 23 and the secondary transfer outer roller 24, thereby performing a secondary transfer operation of the four-color toner image on the intermediate transfer belt 5 onto the recording medium P.

After the four-color toner image is transferred to the recording medium P, the recording medium P is transported to a fixing device 9, where it is heated and pressed between a fixing roller 9*a* and pressure roller 9*b* so as to fix the four-color toner image on the surface of the recording medium. Thus, a four-color full color image is formed. After a four-color toner image is transferred, the residual toner on the surface of the intermediate transfer belt 5 (residual toner after secondary transfer) is removed by an intermediate transfer cleaner 10, so that the intermediate transfer belt 5 can be employed in a successive image formation operation.

Toner supply containers 8Y, 8M, 8C and 8K store toner to be supplied to the respective color developing devices 4Y, 4M, 4C and 4K.

Next, a configuration of each member and so forth and conditions for image formation will be described with regard to an image formation station Y for forming yellow toner images. Note that the other color image formation stations M, C and K have the same configuration as the yellow image formation station Y, so detailed descriptions regarding these elements are omitted as appropriate.

The yellow developing device 4Y transports toner to a developing sleeve 42 while stirring toner with a toner transporting mechanism within a developer container 41 shown in FIG. 1, and coats the circumference of the developing sleeve 42 with a thin layer of toner with a controlling blade pressed and adhered to the circumference of the developing sleeve 42. The toner particles become charged due to the above-described stirring, transporting and controlling actions. Applying developing bias, wherein AC bias is superimposed on DC bias, to the developing sleeve 42, causes charged toner particles to adhere to an electrostatic latent image which has been formed on the photosensitive drum 1Y, so as to develop the electrostatic latent image. The above-described developing sleeve 42 is disposed at a position facing the photosensitive drum 1Y with a minute distance (approximately 300 $\mu$m) therebetween.

In the present embodiment, the potential of the photosensitive drum 1Y, the potential of the developing sleeve 42, and the potential applied to the primary transfer roller 6Y are set as described below.

In an environment having a temperature of 23° C. and relative humidity of 50%Rh, applying alternating bias which superimposes an AC bias having a voltage alternating between peaks of 900 Vp-p on a DC bias of −450 V to a charging roller 3Y controls the surface potential of the photosensitive drum 1Y so as to be −450 V.

On the other hand, an alternating bias which superimposes AC components of voltage alternating between peaks of 1.2 kVp-p on a DC component of −300 V is applied to the developing sleeve 42. Note that the waveform of the AC components at this time is a blank pulse waveform, and a waveform wherein an AC waveform of 9 kHz is combined with a blank of 4.5 kHz is applied as the developing bias.

When the exposure device 2Y exposes the photosensitive drum 1Y with light modulated in accordance with an image, portions where an electrostatic latent image is formed have as a maximum density image change to a light potential of −200 V.

When a potential of +400 V is applied as the primary transfer bias to the primary transfer roller 6Y, the potential differential (primary transfer contrast) between the primary transfer roller 6Y and the light of the photosensitive drum 1Y changes to 600 V. With this primary transfer contrast, toner having a negative polarity on the photosensitive drum 1Y is transferred by a primary transfer operation onto the intermediate transfer belt 5.

The intermediate transfer belt 5 comprises a polyimide resin film having a thickness of 85 μm as a base member, which was subjected to resistance adjustment so that $1\times10^{12}$ Ω/□ in surface resistivity and $1\times10^{9.5}$ Ω·cm in volume resistivity were satisfied by dispersing of Carbon Black. The circumferential length of the intermediate transfer belt 5 is 895 mm, and the driving speed (processing speed) is 130 mm/sec.

The secondary transfer outer roller 24 is a sponge roller having a rubber foam layer, where a steel core having an outer diameter of 12 mm was subjected to foaming processing, employing NBR (nitrile-buitadiene rubber) as a base member, and the outer diameter including the NBR rubber layer was 24 mm. The secondary transfer outer roller 24 is subjected to resistance adjustment so that the resistance value of the roller is 107.5 Ω (when applying 2 kV) under an environment having a temperature of 23° C. and relative humidity of 50%Rh by dispersing resistance adjuster with ionic conductance.

In an image formation apparatus according to the present embodiment, respective primary transfer operations are performed at four primary transfer positions T1 for forming four-color component toner images yellow, magenta, cyan and black. Accordingly, in the present embodiment, the first contact member is the driving roller 21, which is positioned immediately downstream of the primary transfer position T1 (K) of the intermediate transfer belt 5.

In an image formation apparatus according to the present embodiment, line drawing is formed in the thrust direction (direction of width, i.e., direction orthogonal to rotating (moving) direction) of the intermediate transfer belt 5 employing black toner, thereby confirming whether or not there is scattering of toner.

As described above, with regard to the image formation apparatus shown in FIG. 1, of the members which are disposed so as to come into contact with the intermediate transfer belt 5 downstream of the primary transfer position T1 of the black image formation station K farthest downstream in the rotating direction of the intermediate transfer belt 5, the member disposed closest to the black primary transfer position T1 is the driving roller 21.

Figure 2:
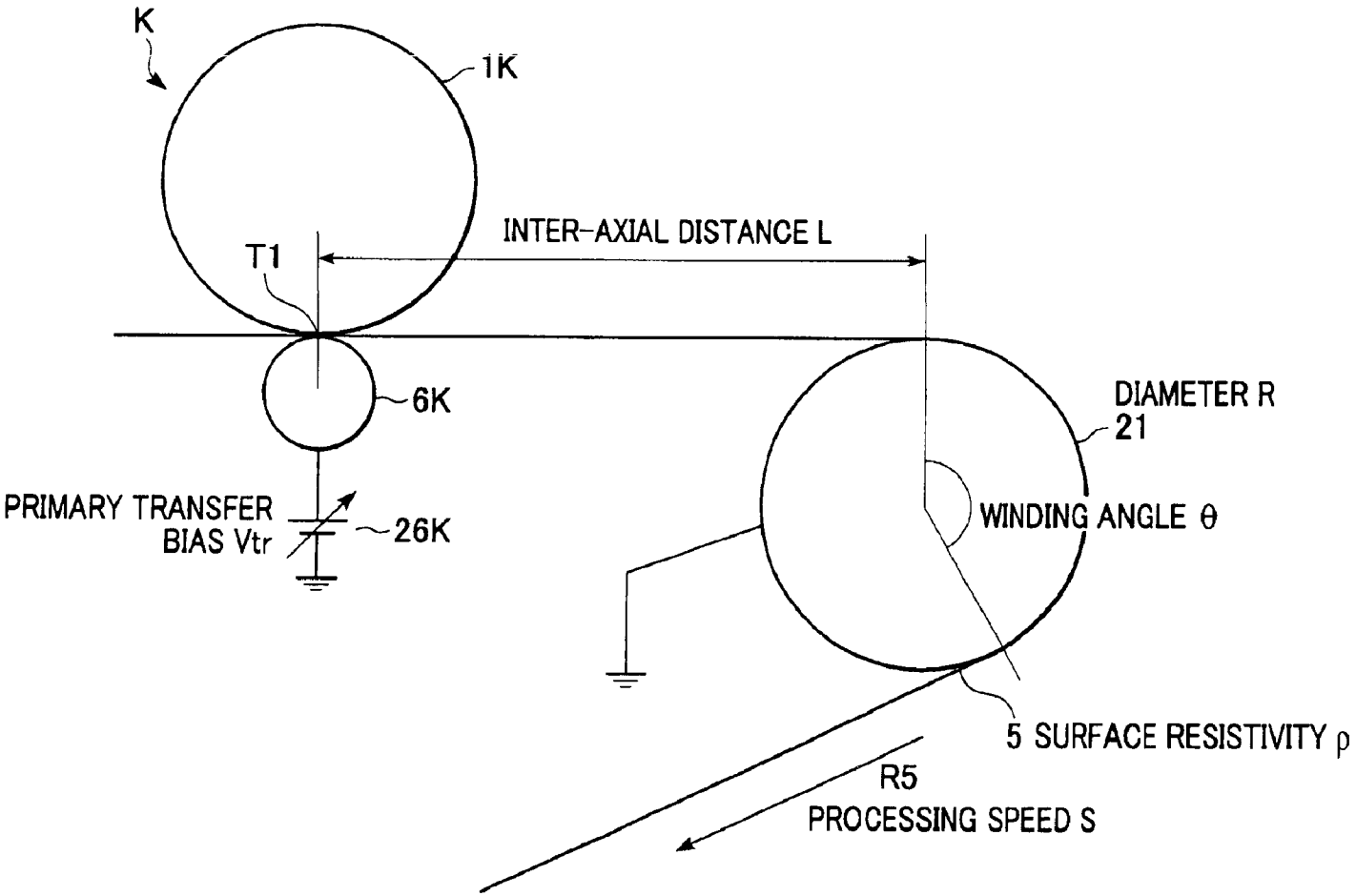
FIG. 2 is an explanatory diagram describing a configuration close to a primary transfer portion and driving roller (contact member), and conditions thereof.

As shown in FIG. 2, the inter-axial distance between the primary transfer roller 6K of the black image formation station K and the driving roller 21 (distance from the primary transfer position T1 (K) to the position where the intermediate transfer belt first comes into contact with the driving roller) was L (mm), the primary transfer bias applied to the primary transfer roller 6*k* was Vtr (kV), the surface resistivity of the intermediate transfer belt 5 was ρ (Ω/□), the processing speed of the intermediate transfer belt 5 was s (mm/sec), and the above-mentioned parameters were each set as shown in FIG. 9, so as to determine whether or not widening of the line drawing occurred immediately prior to the line drawing on the intermediate transfer belt 5 reaching the driving roller 21. Note that the driving roller 21 employed at this time comprises an electroconductive metal, and is employed in a grounded state.

Whether or not widening of line drawings occurred was confirmed with regard to each parameter setting for 14 examples (Examples 1 through 5, Comparative Examples 1 through 9) shown in FIG. 9. FIG. 9 shows whether or not widening of line drawings occurred, in three levels; none, negligible, and visible to an extent of causing image deterioration. Note that here, Examples 1 through 5 are combinations of parameters resulting in no problem, whereas Comparative Examples 1 through 9 are problematic combinations of parameters (resulting in some level of image degradation/deterioration).

The above-described parameters were each confirmed to contribute to widening of line drawings. That is to say, the higher the primary transfer bias Vtr becomes, the more serious the widening of line drawings becomes (becomes marked).

As represented by scattering of line drawings by discharge due to peeling off at the driving roller 21, increase/decrease of scattering of toner particles in the image formation apparatus shown in FIG. 1, is assumed to depend on the potential of the back side of the intermediate transfer belt 5 in the event of the intermediate transfer belt 5 coming into contact with the driving roller 21, and the potential of the back side of the intermediate transfer belt 5 in the event of the intermediate transfer belt 5 peeling off from the driving roller 21. In either case, reducing the potential difference as to the grounded driving roller 21 prevents discharge due to peeling off from occurring, and it is presumed that scattering of toner particles can thus be reduced.

Immediately after the intermediate transfer belt 5 passes through the primary transfer position T1 of the black image formation station K, the potential of the back side of the intermediate transfer belt 5 is approximately equal to the potential of the front side of the primary transfer roller 6K. If the intermediate transfer belt 5 holds a high potential at a portion that first comes into contact with the grounded driving roller 21, discharge is caused between the intermediate transfer belt 5 and the driving roller 21, and it is thought that this leads to scattering of toner particles.

Moreover, with regard to the inter-axial distance L between the primary transfer roller 6K and the driving roller 21, the shorter this distance becomes, the more serious the widening of line drawings becomes; also, the higher the processing speed becomes, the more serious the widening of line drawings becomes. It is thought that the potential of the back side of the intermediate transfer belt 5 is attenuated until the intermediate transfer belt 5 reaches the driving roller 21 after passing through the primary transfer position T1, and consequently, suitably attenuating the potential of the back side so as to be less than the potential applied in the primary transfer position T1 within a range that toner images do not scatter, is advantageous to reduce scattering of toner.

The potential of the back side of the intermediate transfer belt 5 is approximately equal to the potential of the primary transfer bias Vtr applied to the primary transfer roller 6K in the black image formation station K. The time required to reach the driving roller 21 is represented as L/s (sec) employing the inter-axial distance L (mm) between the primary transfer roller 6K and the driving roller 21, and the processing speed s (mm/sec) of the intermediate transfer belt 5. Also, the property time in the event that the potential of the back side of the intermediate transfer belt 5 is attenuated until the intermediate transfer belt 5 reaches the driving roller 21, is regarded as approximately proportional to the surface resistivity ρ (Ω/□) of the intermediate transfer belt 5.

At this time, $$Vtr\times\exp^{-L/(s\times\log\rho)}$$

is introduced as an indicator to represent how much the amount of attenuation is, and the naturalized logarithm of this indicator, $$ln(Vtr)-L/(s\times\log\rho),$$

is defined as attenuance, wherein the absolute value of the primary transfer bias is used for Vtr.

This attenuance is an indicator that represents how much the potential of the back side applied by the primary transfer roller 6K is attenuated toward ground potential, and in the event that this value is small, this means that the holding capability of the potential (charge) is high, so that scattering of toner by discharge upstream of the driving roller 21 readily occurs due to the high potential. On the other hand, in the event that this value is great, this means that the holding capability of potential (charge) is low, so the holding capability of toner due to the charge on the intermediate transfer belt 5 deteriorates, and consequently, scattering of toner readily occurs.

As will be understood from FIG. 9, when the attenuance is less than −1.0 but greater than −2.0, a configuration can be obtained where scattering of toner due to discharge generated on the back side of the intermediate transfer belt 5 upstream of the driving roller 21, and scattering of toner on the intermediate transfer belt 5 because the intermediate transfer belt 5 cannot hold the charge on the back side thereof, can be prevented.

Next, the intermediate transfer belt 5 was further transported, and it was determined whether or not widening of line drawings resulting from peeling off from the driving roller 21 occurred following a setting of the parameters as shown in FIG. 10. In this case, the parameters that were set were the surface resistivity ρ (Ω/□) of the intermediate transfer belt 5, the diameter R (mm) of the driving roller 21, and the winding angle θ (deg) as to the driving roller 21 of the intermediate transfer belt 5.

Whether or not widening of line drawings occurred was determined with regard to each parameter setting for 12 examples (Examples 6 through 10, Comparative Examples 10 through 16) shown in FIG. 10. FIG. 10 shows whether or not widening of line drawings occurred, in three levels; none, negligible, and visible to an extent of causing image deterioration. Note that Examples 6 through 10 are combinations of parameters resulting in no problem, and Comparative Examples 10 through 16 are problematic combinations of parameters resulting in some degree of image deterioration.

Significant differences in occurrence of widening of line drawings were observed with regard to the above-described parameters, as well.

Figure 3:
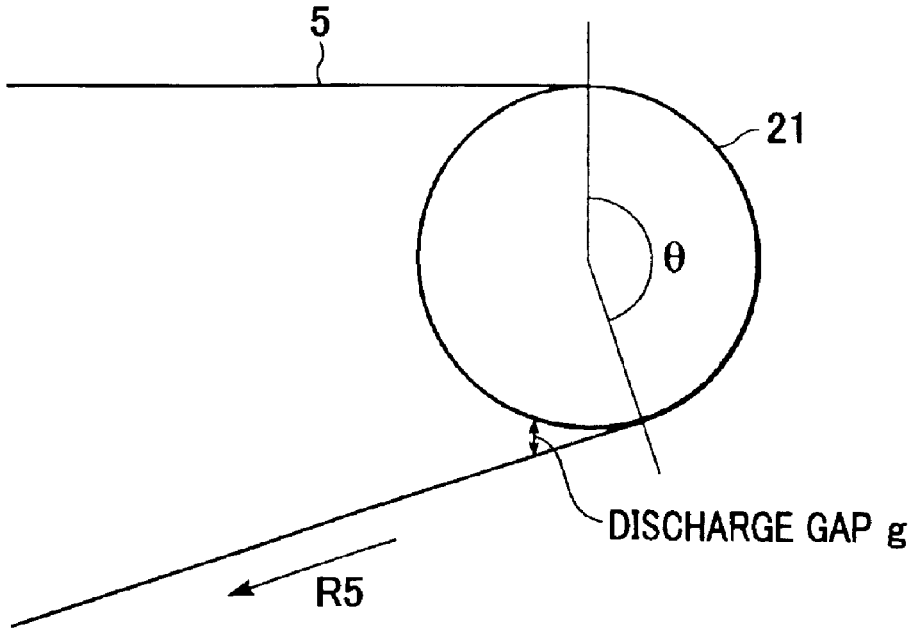
FIG. 3 is an explanatory diagram describing a state wherein an intermediate transfer belt is peeled off from the grounded driving roller.

That is to say, the greater the diameter of the driving roller 21 becomes, the more serious the widening of line drawings becomes (widening of line drawings becomes marked). This is because, as shown in FIG. 3, in the event that discharge occurs at a position (discharge gap g) where the intermediate transfer belt 5 peels off from the driving roller 21 downstream from the driving roller 21, discharge occurs at a vacant portion of the gap according to Paschen's law. In this case, if the diameter of the driving roller 21 is increased, the curvature thereof is reduced, and consequently, the range of occurrence of discharge is widened, whereby discharge readily occurs. Accordingly, if a driving roller 21 having a large diameter is employed, the range of occurrence of discharge due to peeling off is widened, and scattering of toner is made worse by discharge due to peeling off, and marked widening of line drawings is observed.

Figure 4B:
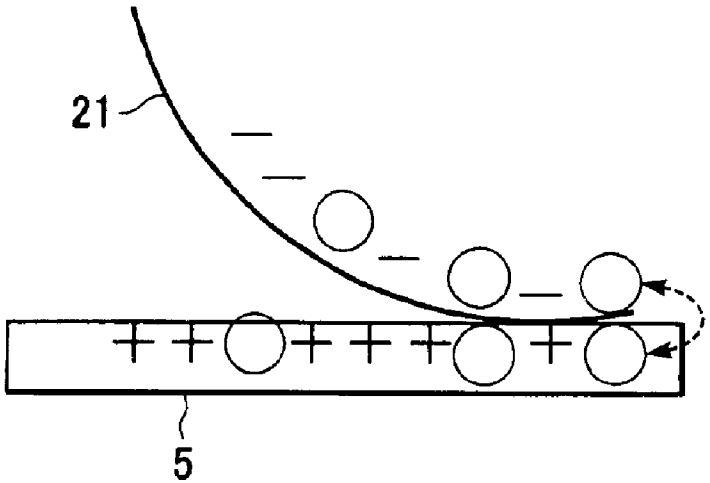
FIG. 4B is a diagram illustrating a state wherein charge is neutralized at a low peeling off speed of the intermediate transfer belt.
Figure 4A:
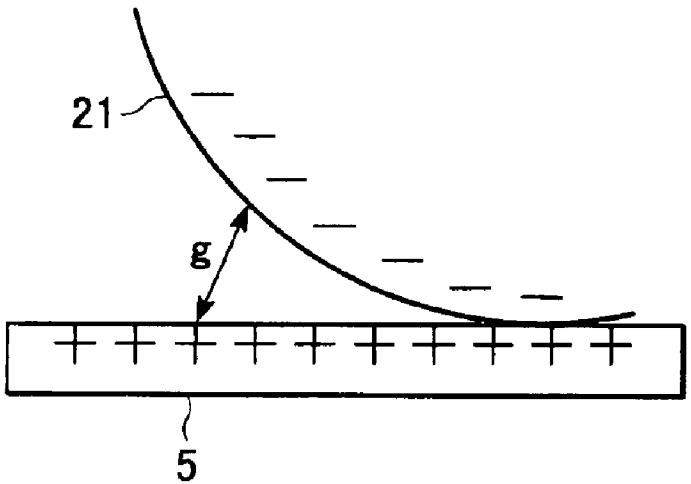
FIG. 4A is a diagram illustrating a state wherein charge is neutralized at a high peeling off speed of the intermediate transfer belt.
Figure 5:
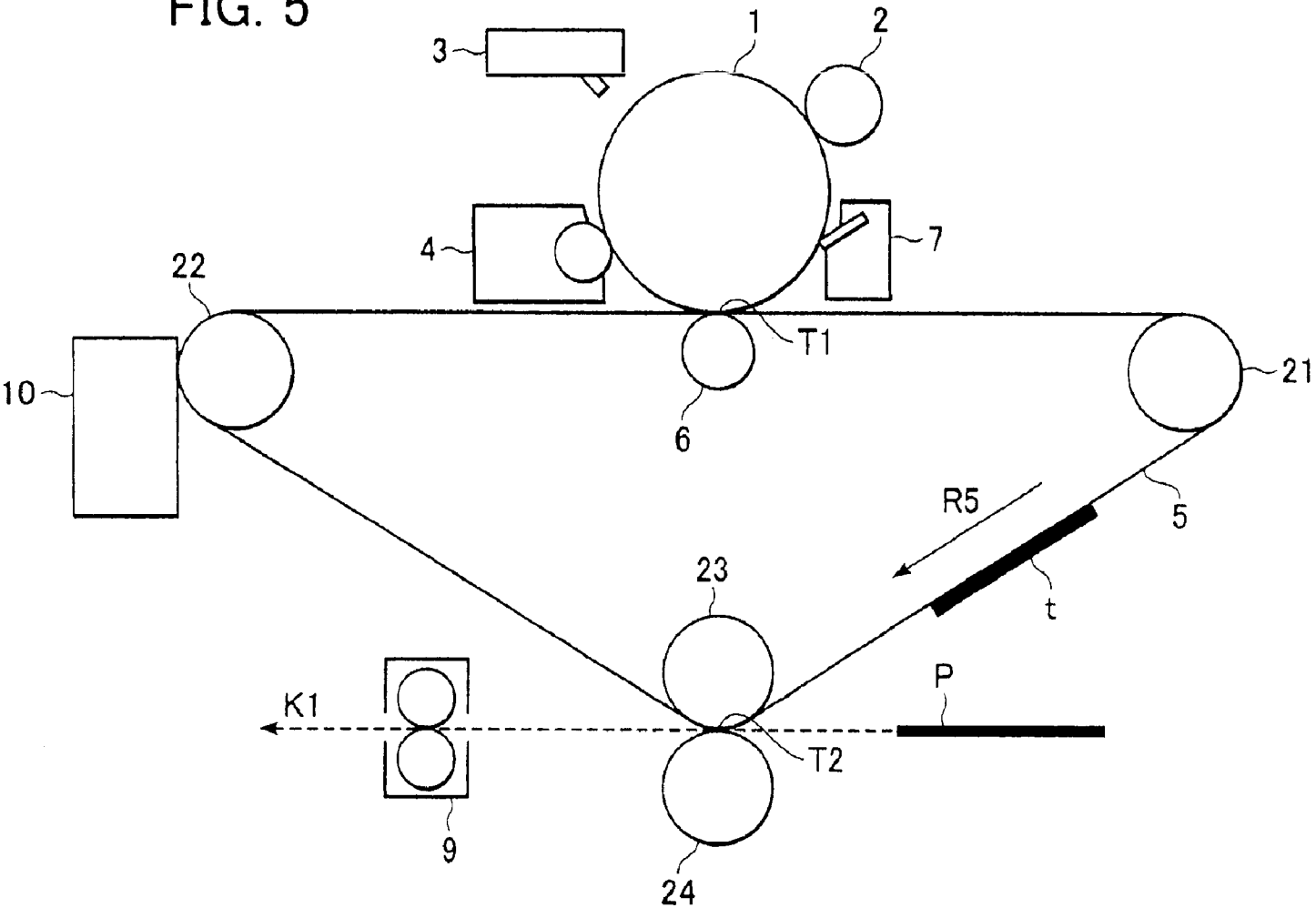
FIG. 5 is a vertical cross-sectional diagram illustrating a schematic configuration of a conventional image formation apparatus.
Figure 6:
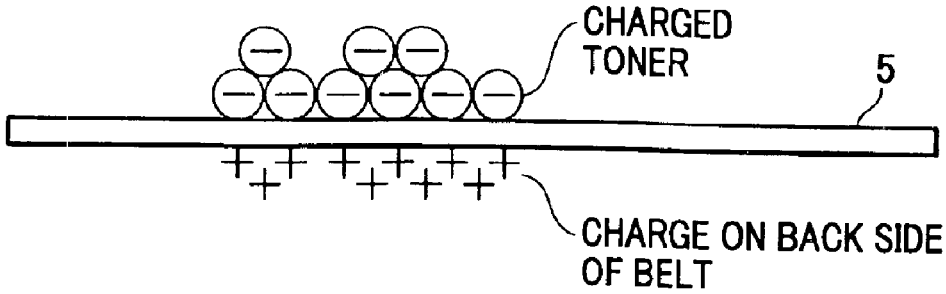
FIG. 6 is a diagram illustrating a state wherein charged toner is electrostatically held on the intermediate transfer belt.
Figure 7:
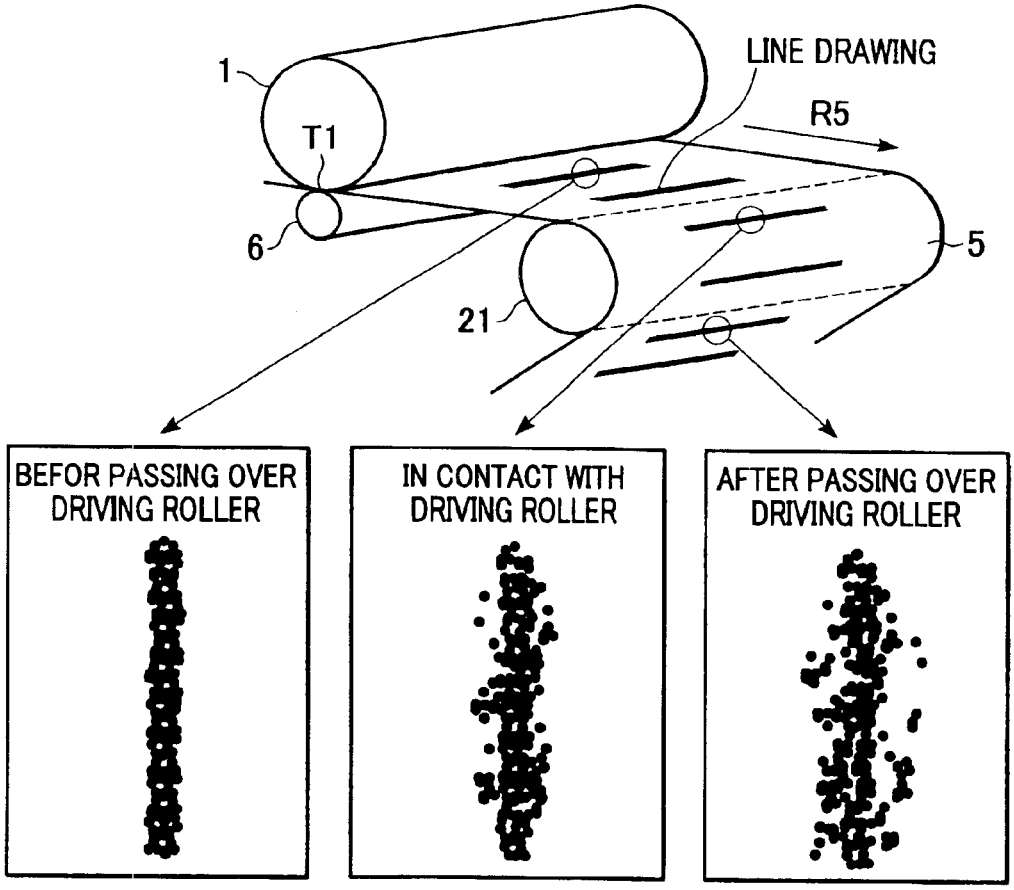
FIG. 7 is a diagram illustrating the widening of a line drawing in the event of the intermediate transfer belt coming into contact with the driving roller and in the event of passing over the driving roller.
Figure 8:
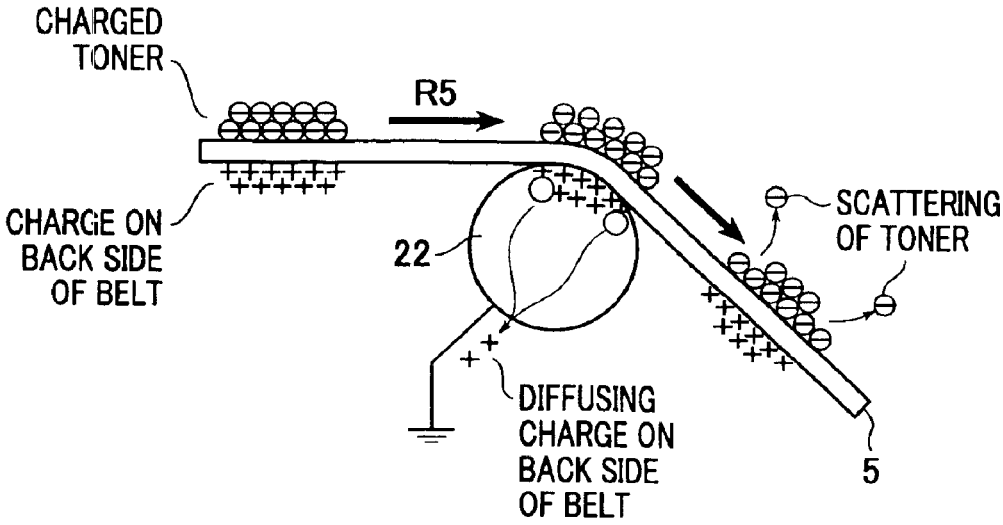
FIG. 8 is an explanatory diagram describing a state wherein toner on the surface of the intermediate transfer belt scatters due to a driving roller that is grounded coming into contact with the back side of the intermediate transfer belt.

On the other hand, if a driving roller 21 having an excessively small diameter is employed, widening of line drawing is marked, as well. As shown in FIGS. 4A and 4B, in the event of peeling off, exchange of charge between contact members occurs, such that some of the charge is neutralized, thereby reducing the charge amount due to peeling off. As shown in FIG. 4A, in the event of a high peeling off speed, neutralization of the charge hardly occurs because the charge is prevented from moving, whereby the charge amount due to peeling off increases. If a roller has too small a diameter, the peeling off speed is higher, neutralization of charge hardly occurs, and peeling off is performed while holding a great charge, so discharge due to peeling off readily occurs. Accordingly, scattering of toner following discharge due to peeling off is thought to become even more marked unless a suitable diameter is selected for the driving roller 21.

Moreover, If the surface resistivity of the intermediate transfer belt 5 is too high, or too low, widening of line drawing is marked. That is, if the surface resistivity of the intermediate transfer belt 5 is too high, any charge due to the above-described peeling off hardly moves, and the charge is not subjected to neutralization, so peeling off is performed while holding too great a charge, and accordingly discharge due to peeling off readily occurs. On the other hand, if the surface resistivity is too low, discharge due to peeling off occurs following peeling off, even if some of the charge at a portion where discharge occurs is lost, relocation of the charge is immediately effected so as to absorb unevenness of charge on the surface of the intermediate transfer belt 5, and the charge density of the entire back side of the intermediate transfer belt 5 is reduced, whereby scattering of toner occurs over a wide range. Accordingly, with the intermediate transfer belt 5, selecting an appropriate surface resistivity effectively avoids scattering of toner due to discharge owing to peeling off.

Moreover, with regard to the winding angle θ, the smaller this value becomes, the more unstable driving transmission by the driving roller 21 becomes, and the greater the disturbance in movement of the belt at the region of discharge gap g in FIG. 3 becomes, which causes scattering of toner. Accordingly, the winding angle θ is preferably a value equal to or greater than a value where stable transportation of the belt can be obtained.

As described above, downstream of the driving roller 21, it is clear that a configuration which effectively suppresses discharge due to peeling off at the time the intermediate transfer belt 5 is peeling off from the driving roller 21, thereby preventing widening of line drawing from occurrence, satisfies $$20 \leqq \log\rho \times R \times \theta/360 \leqq 200.$$

Also, as a preferable configuration wherein widening of line drawing can be prevented in a reliable manner, employing a configuration in the range satisfying $$160 \leqq \log\rho \times R \times \theta/360 \leqq 200$$

can avoid scattering of toner by discharge due to peeling off in a reliable manner.

Note that while the driving roller 21 has been described as being made of metal in the above-described experiment, the present invention is not restricted to this embodiment. For example, the same effects can be obtained with a configuration wherein an electroconductive rubber layer is provided on the surface of a metal roller.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation apparatus comprising:

image formation means for forming toner images on an image holding member;

primary transfer means for transferring toner images formed on the image holding member onto an intermediate transfer member at a primary transfer portion;

secondary transfer means for transferring toner images on the intermediate transfer member onto a recording medium at a secondary transfer portion; and a contact member which is electrically grounded and first contacts the intermediate transfer member downstream of the primary transfer portion in the moving direction of the intermediate transfer member, wherein the following relation is satisfied:

$$-2.0 \leqq ln(Vtr) - L/(s \times \log\rho) \leqq -1.0$$

where:

L (mm) represents a distance from the primary transfer portion to a position where the contact member first contacts the intermediate transfer member, Vtr (V) represents an absolute value of a voltage applied to the primary transfer means, s (mm/sec) represents a moving speed of the intermediate transfer member, and ρ (Ω/□) represents a surface resistivity of the intermediate transfer member.

2. An image formation apparatus according to claim 1, wherein the primary transfer means include a transfer member that contacts the intermediate transfer member.

3. An image formation apparatus according to claim 1, wherein the intermediate transfer member has a belt shape, and the contact member has a roller shape.

4. An image formation apparatus according to claim 3, wherein the contact member is a driving roller which moves the intermediate transfer member, and the following relation is satisfied:

$$20 \leqq (\log\rho) \times R \times \theta/360 \leqq 200$$

where:

R (mm) represents a diameter of the driving roller, and

θ represents a winding angle of the intermediate transfer member about the driving roller.

5. An image formation apparatus according to claim 3, wherein the contact member is a driving roller which moves the intermediate transfer member, and the relation of $$160 \leqq (\log\rho) \times R \times \theta/360 \leqq 200$$

is satisfied in which R (mm) represents a diameter of the driving roller, and

θ represents a winding angle as to the driving roller of the intermediate transfer member.

6. An image formation apparatus comprising:

a developer that forms toner images on an image holding member;

a primary transfer device that transfers toner images formed on the image holding member onto an intermediate transfer member at a primary transfer portion;

a secondary transfer device that transfers toner images on the intermediate transfer member onto a recording medium at a secondary transfer portion; and a contact member which is electrically grounded and first contacts the intermediate transfer member downstream of the primary transfer portion in the moving direction of the intermediate transfer member, wherein the following relation is satisfied:

$$-2.0 \leqq ln(Vtr) - L/(s \times \log\rho) \leqq -1.0$$

where:

L (mm) represents a distance from the primary transfer portion to a position where the contact member first contacts the intermediate transfer member, Vtr (V) represents an absolute value of a voltage applied to the primary transfer device, s (mm/sec) represents a moving speed of the intermediate transfer member, and ρ (Ω/□) represents a surface resistivity of the intermediate transfer member.

7. An image formation apparatus comprising:

image formation means for forming respective toner images on a plurality of image holding members;

primary transfer means for transferring the respective toner images formed on the image holding members onto an intermediate transfer member at respective primary transfer portions, the toner images being superposed one on another to form a multi-toner image;

secondary transfer means for transferring the multi-toner image on the intermediate transfer member onto a recording medium at a secondary transfer portion; and a contact member which is-electrically grounded and first contacts the intermediate transfer member downstream of a last primary transfer portion in the moving direction of the intermediate transfer member, wherein the following relation is satisfied:

$$-2.0 < ln(Vtr) - L/(s \times \log\rho) \leqq -1.0$$

where:

L (mm) represents a distance from a last primary transfer portion to a position where the contact member first contacts the intermediate transfer member, Vtr (V) represents an absolute value of a voltage applied to the primary transfer means at the last primary transfer portion, s (mm/see) represents a moving speed of the intermediate transfer member, and ρ(Ω/□) represents a surface resistivity of the intermediate transfer member.

8. An image formation apparatus according to claim 7, wherein the respective toner images include four different color toner images, and the multi-toner image is a four-color toner image.

* * * * *